US009879635B2

(12) United States Patent
Rohs

(10) Patent No.: US 9,879,635 B2
(45) Date of Patent: Jan. 30, 2018

(54) AXIAL PISTON ENGINE AND METHOD FOR OPERATING AN AXIAL PISTON ENGINE

(75) Inventor: Ulrich Rohs, Dueren (DE)

(73) Assignee: GETAS Gesellschaft für thermodynamische Antriebssysteme mbH, Düren (DE)

( * ) Notice: Subject to any disclaimer, the term of this patent is extended or adjusted under 35 U.S.C. 154(b) by 893 days.

(21) Appl. No.: 12/734,508

(22) PCT Filed: Nov. 10, 2008

(86) PCT No.: PCT/DE2008/001836
§ 371 (c)(1),
(2), (4) Date: May 6, 2010

(87) PCT Pub. No.: WO2009/062473
PCT Pub. Date: May 22, 2009

(65) Prior Publication Data

US 2010/0258065 A1 Oct. 14, 2010

(30) Foreign Application Priority Data

Nov. 12, 2007 (DE) ..... 10 2007 054 204
Nov. 19, 2007 (DE) ..... 10 2007 055 337
Nov. 23, 2007 (DE) ..... 10 2007 056 814

(51) Int. Cl.

| | |
|---|---|
| ***F02B 75/18*** | (2006.01) |
| ***F02G 3/02*** | (2006.01) |
| ***F01B 3/00*** | (2006.01) |
| ***F01B 3/04*** | (2006.01) |
| ***F02B 75/26*** | (2006.01) |

(52) U.S. Cl.
CPC ..... *F02G 3/02* (2013.01); *F01B 3/0005* (2013.01); *F01B 3/04* (2013.01); *F02B 75/26* (2013.01); *F02G 2254/10* (2013.01)

(58) Field of Classification Search
USPC ..... 123/56.1, 258, 269
See application file for complete search history.

(56) References Cited

U.S. PATENT DOCUMENTS 3,893,295 A 7/1975 Airas
3,895,614 A * 7/1975 Bailey ..... 123/67
3,973,393 A * 8/1976 Vogelsang ..... F02G 1/02 123/41.37
4,024,703 A 5/1977 Hudson
(Continued)

FOREIGN PATENT DOCUMENTS

CN 1910361 A 2/2007
CN 1918432 A 8/2008
(Continued)

OTHER PUBLICATIONS

Chinese Second Office Action dated Sep. 25, 2015 in Chinese Patent Application 201310167861.4.
(Continued)

*Primary Examiner* — Carlos A Rivera
*Assistant Examiner* — Ruben Picon-Feliciano
(74) *Attorney, Agent, or Firm* — Collard & Roe, P.C.

(57) ABSTRACT

To improve the efficiency of an axial piston engine, the invention proposes an axial piston engine with a combustion chamber which operates with two-stage combustion.

26 Claims, 3 Drawing Sheets

(56) References Cited

U.S. PATENT DOCUMENTS

Figure 1:
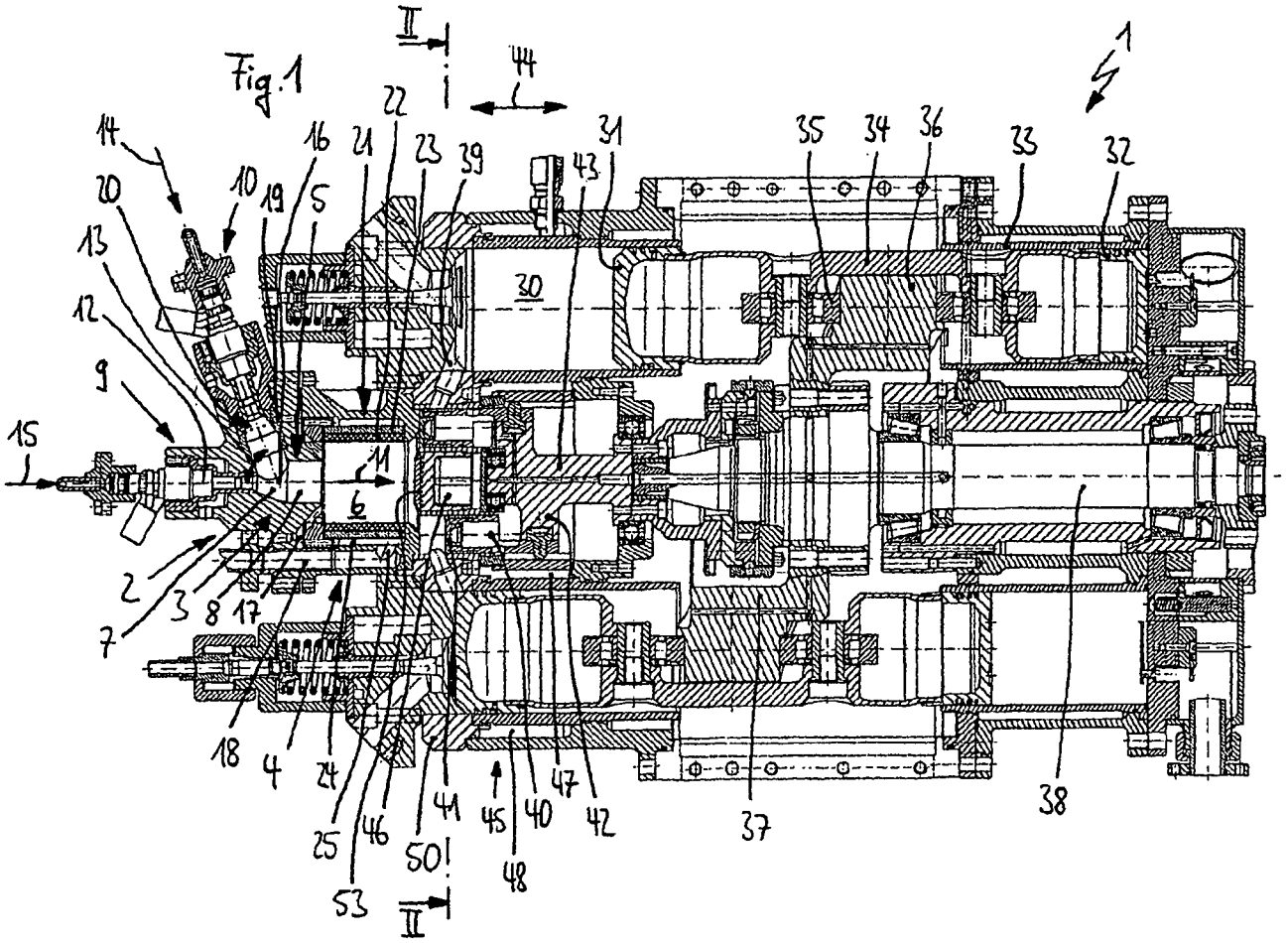

| | | | | |
|---|---|---|---|---|
| 4,448,154 | A | 5/1984 | Kossel | |
| 4,781,152 | A | 11/1988 | Pellerin | |
| 5,069,029 | A | 12/1991 | Kuroda et al. | |
| 5,203,298 | A | 4/1993 | Manolis | |
| 5,549,032 | A | 8/1996 | Long | |
| 5,904,044 | A | 5/1999 | White | |
| 6,412,273 | B1 * | 7/2002 | Rohs | 60/39.63 |
| 6,536,207 | B1 | 3/2003 | Kamen et al. | |
| 6,951,211 | B2 * | 10/2005 | Bryant | F01B 7/12 123/316 |
| 7,677,210 | B2 * | 3/2010 | Chasin | F01B 3/0032 123/43 R |
| 2002/0043067 | A1 | 4/2002 | Maeda et al. | |
| 2007/0151528 | A1 * | 7/2007 | Hedman | 123/25 D |
| 2007/0256658 | A1 * | 11/2007 | Andersson et al. | 123/193.5 |
| 2008/0193886 | A1 * | 8/2008 | Amano et al. | 431/9 |

FOREIGN PATENT DOCUMENTS

| | | | |
|---|---|---|---|
| DE | 2400052 | A1 | 7/1974 |
| DE | 28 26 932 | | 1/1980 |
| DE | 19909689 | A1 | 9/2000 |
| EP | 0 554 325 | B1 | 7/1995 |
| EP | 1 035 310 | | 9/2000 |
| FR | 2442336 | A1 | 6/1980 |
| GB | 2 094 464 | A | 9/1982 |
| JP | S6126774 | Y2 | 8/1986 |
| JP | 62-267520 | | 11/1987 |
| JP | S62267520 | A | 11/1987 |
| JP | S63217141 | A | 9/1988 |
| JP | H0289916 | A | 3/1990 |
| JP | H06502240 | A | 3/1994 |
| JP | H07233945 | A | 9/1995 |
| SU | 799556 | | 3/1986 |
| SU | 1740762 | A1 | 6/1992 |
| WO | 89/05399 | A1 | 6/1989 |

OTHER PUBLICATIONS

International Search Report.
European Search Report in EP 08 849 887.8, dated Sep. 1, 2017, with English translation of relevant parts.

* cited by examiner

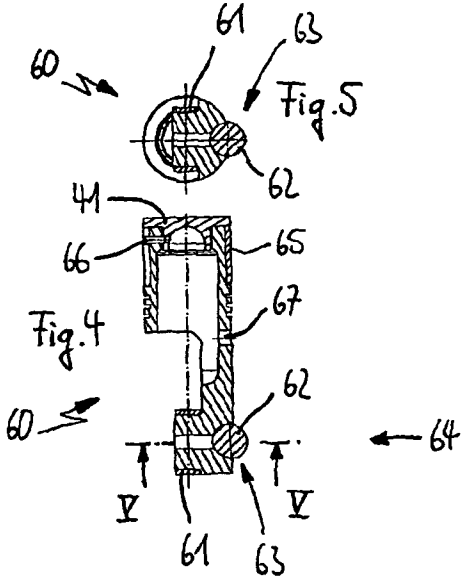
Fig.5
Fig.4
60
61
62
63
64
65
66
67
41
V
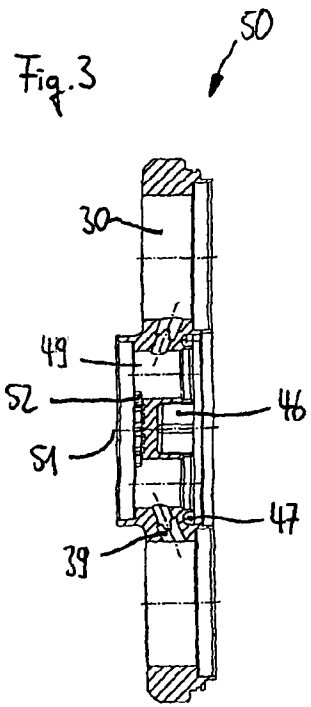
Fig.3
50
30
39
46
47
49
51
52

AXIAL PISTON ENGINE AND METHOD FOR OPERATING AN AXIAL PISTON ENGINE

CROSS REFERENCE TO RELATED APPLICATIONS

This application is the National Stage of PCT/DE2008/001836 filed on Nov. 10, 2008, which claims priority under 35 U.S.C. §119 of German Application No. 10 2007 054 204.8 filed on Nov. 12, 2007, German Application No. 10 2007 055 337.6 filed on Nov. 19, 2007, and German Application No. 10 2007 056 814.4 filed on Nov. 23, 2007. The international application under PCT article 21(2) was not published in English.

The invention relates to an axial piston engine with a combustion chamber. The invention also relates in particular to an axial piston engine with a combustion chamber which is insulated by means of a ceramic assembly. The invention likewise relates to an axial piston engine with continuous combustion in which working medium which flows out of a combustion chamber is supplied successively to at least two working cylinders via at least one firing channel. The invention finally also relates to a method for operating an axial piston engine.

Generic axial piston engines and methods are disclosed for example in EP 1 035 310 A2 and are therefore already known from the prior art.

It is the object of the present invention to provide an axial piston engine with optimised efficiency.

As a first solution, an axial piston engine with a combustion chamber which operates with two-stage combustion is proposed. The fact that a combustion chamber is present, which is constructed in such a manner that it can operate with two-stage combustion, means that the chemical energy which is present in a fuel can be used or converted into useable energy much more effectively in the axial piston engine according to the invention, as a result of which the efficiency of the axial piston engine is improved.

To this end, it is particularly advantageous from a design standpoint if the combustion chamber has two regions into which a fuel and/or air is injected. In this case the fuel and the air can be injected together or separately into the different regions of the combustion chamber.

In this connection in particular, a preferred embodiment provides for the combustion chamber to have a first region in which a portion of the combustion air is introduced and in which a preparation nozzle injects a corresponding quantity of fuel. The combustion process is initiated particularly effectively by the preparation nozzle, in which fuel is already mixed with a very small portion of combustion air and is thus prepared for combustion, and by the additional supply of combustion air, as a result of which the combustion of the fuel can proceed more effectively overall.

It is in particular advantageous if the portion of combustion air which is introduced into the first region as an additional portion is less than 50% of the total combustion air, preferably less than 15%, in particular less than 10%. If the combustion air portion lies within such limits, the possibility of improving the combustion of the fuel by means of two-stage combustion exists just because of this.

A fuel can in particular be injected particularly well into the combustion chamber of the axial piston engine if the axial piston engine has a main nozzle and an auxiliary nozzle. Depending on the configuration of the combustion of the fuel or of a corresponding fuel/air mixture, a fuel/air mixture could also be sprayed into the combustion chamber by means of such a main nozzle. The main nozzle therefore ensures that a substantial portion of fuel passes into the combustion chamber of the axial piston engine in a defined advance direction, whereas a certain portion of fuel or of a fuel/air mixture passes into the combustion chamber through the auxiliary nozzle which can be configured for example as a preparation nozzle, which portion can be used for supporting purposes such as post-combustion, preparation or tempering.

Specifically in this connection, the object of the invention is also achieved by an axial piston engine with a combustion chamber into which fuel can be injected by means of a main nozzle and into which fuel which is mixed with air can be injected by means of a preparation nozzle. Virtually any desired fuel/air mixture can advantageously be injected into the combustion chamber by means of such a preparation nozzle, whereas ideally only fuel is injected by means of the main nozzle. The efficiency of an axial piston engine is improved by this allocation. If it is advantageous for an application, more than one preparation nozzle can also be provided. The above-mentioned advantage in particular also applies independently of the use of two-stage combustion or of a combustion chamber having two regions.

If the main nozzle is aligned parallel to a main combustion direction in the combustion chamber, the fuel can be injected into the combustion chamber particularly well in such a manner that it can ignite and burn exceptionally effectively. An ignited or burnt fuel/air mixture can in particular pass through the entire combustion chamber and be conducted further via firing channels out of the combustion chamber and into working cylinders of the axial piston engine with higher kinetic energy if the fuel is injected out of the main nozzle into the combustion chamber in the main combustion direction. In this manner the fuel or the fuel/air mixture can be fed quickly to the regions of the axial piston engine in which it is to carry out its work, such as the cylinders.

It is also advantageous if the main nozzle is aligned coaxially to an axis of symmetry of the combustion chamber which lies parallel to the main combustion direction in the combustion chamber. If the main nozzle is situated centrally on the axis of symmetry of the combustion chamber, a corresponding essential combustion takes place so that the combustion gases can then also be removed from the combustion chamber for further use in a correspondingly symmetrical manner, even if other components are supplied through an auxiliary or preparation nozzle which cannot however get through so substantially.

An advantageous embodiment provides for the preparation nozzle to be aligned at an angle to the main nozzle. Both the main nozzle and the preparation nozzle can thereby be placed constructively in a narrow space in the combustion chamber and connected.

It is furthermore advantageous if the jet direction of the preparation nozzle intersects the jet direction of the main nozzle, as a result of which a fuel which is injected through the main nozzle into the combustion chamber and a fuel/air mixture which is injected through the preparation nozzle into the combustion chamber can be particularly well swirled and mixed together for example in the region of a prechamber of a preparation chamber.

In order to be able to introduce the fuel from the main nozzle and the fuel/air mixture from the preparation nozzle into the combustion chamber, it is advantageous if the axial piston engine has a preparation chamber into which both a main nozzle and a preparation nozzle are pointed and which opens towards the main combustion chamber. It is thereby always ensured that the fuel from the main nozzle and the fuel/air mixture from the preparation nozzle can be sufficiently well mixed before they pass into the second region of the combustion chamber, for example into a main combustion chamber of the combustion chamber.

In order to be able to introduce an already preheated fuel into the combustion chamber, it is advantageous if the axial piston engine has a preparation chamber into which the exhaust gas or a fuel/air mixture is introduced from a preparation nozzle and into which fuel is injected from a main nozzle without supplying air.

Furthermore, as an additional or alternative solution of the object of the present invention, a further axial piston engine is proposed, with a combustion chamber and a preparation chamber which is arranged upstream of the combustion chamber, into which fuel is added via a main nozzle, which fuel is heated, preferably already thermally decomposed, in the preparation chamber. Known axial piston engines can be advantageously developed just by means of such a preparation chamber, as a fuel which could be at least already heated in the preparation chamber can be burned more effectively. In particular, sufficient and advantageous two-stage combustion in an axial piston engine can be realised and ensured in the long term thereby.

At this point it should be pointed out that the object of the invention is correspondingly also achieved by a method for operating an axial piston engine in which fuel is decomposed in a first step and then brought into contact with process air for combustion. Advantageously, the decomposed fuel can react more effectively with the process air so that the combustion process proceeds in a correspondingly more effective manner.

It is further advantageous if the decomposition of the fuel takes place thermally. The heat which is needed for this can be generated and provided directly in the axial piston engine without problems. On the other hand, it is self-evident that other decomposition processes such as electrolytic or catalytic processes can also be used cumulatively or alternatively in a corresponding preparation chamber.

It is self-evident that such heat for the thermal decomposition of the fuel can be generated in different ways. If the thermal energy for the decomposition is provided by a preparation flame, the fuel can be thermally decomposed in the axial piston engine in a particularly simple manner from a process engineering standpoint and in particular while using the technology which is used in any case for the combustion of the fuel.

If the preparation flame is generated using a fuel/air mixture, the preparation flame can then be generated and provided in the axial piston engine in a correspondingly simple manner from a design standpoint.

If the portion of fuel which is brought into the combustion chamber or into the preparation chamber by the fuel/air mixture is less than 10% of the total quantity of fuel which is introduced into the combustion chamber, the axial piston engine can be operated in a particularly fuel-saving manner, as in this manner only a minimal quantity of fuel is used for the preparation of the combustion, namely the preparatory decomposition, whereas the rest of the fuel is available for carrying out the desired work. In this case it must also in particular be taken into account that the fuel which is used for the preparation is likewise ultimately available to the process in terms of energy and is used correspondingly for the process. The two-stage approach however ensures that the decomposition of the fuel which is used for carrying out the work takes place or has progressed until it is ignited, which increases the effectiveness of the overall process.

It is furthermore proposed that a preparation nozzle opens into the preparation chamber, by means of which nozzle the fuel in the preparation chamber can be heated. In particular, if combustion air or a combustion air/fuel mixture is added into the preparation chamber by means of the preparation nozzle, the fuel which is likewise added into the preparation chamber via a main nozzle can be heated, preferably even thermally decomposed, in a particularly simple manner in design terms in the region of the preparation chamber and fed to the main combustion chamber. Depending on the actual process, the combustion air/fuel mixture or other gas mixture or gas which is conducted out of the preparation nozzle into the preparation chamber can be dosed in such a manner that sufficient temperatures prevail in the preparation chamber to ensure preparation of the remaining fuel, for example a thermal decomposition.

In order to be able to introduce or inject a fuel/air mixture into the combustion chamber of the axial piston engine in a particularly loss-free and correspondingly advantageous manner, it is advantageous if the preparation chamber is aligned parallel to a main combustion direction in the combustion chamber. This results in particular in the flow of combustion gases being formed uniformly and it being possible to distribute them in a correspondingly uniform manner to different cylinders.

If the preparation chamber is aligned coaxially to an axis of symmetry of the combustion chamber which lies parallel to the main combustion direction in the combustion chamber, the flow of combustion gases can be formed to be correspondingly uniform.

The air/fuel mixture from the preparation chamber can be mixed particularly advantageously with combustion air in the main combustion chamber if the preparation chamber has a smaller diameter than the combustion chamber. In this case the volume of the main combustion chamber should only be so much greater than the preparation chamber that an unimpeded flow from the preparation chamber with additional supply of combustion air through the main combustion chamber into the cylinders can be formed in order to prevent unnecessary expansion in the main combustion chamber, which would result in losses per se, as the work is actually to be carried out in the cylinders.

It is self-evident that such a preparation chamber can be designed in various ways. The preparation chamber ideally comprises a prechamber and a main chamber. While for example the main nozzle and/or the preparation nozzle can open into the prechamber of the preparation chamber, an ignition and/or a precombustion can take place in the main chamber of the preparation chamber.

If preferably both the main nozzle and the preparation nozzle opens into the preparation chamber in the region of the prechamber, the mixtures which are added into the preparation chamber can already be present exceptionally well-prepared in the main chamber of the preparation chamber.

Both the main nozzle and the preparation nozzle can advantageously open into the preparation chamber or into the prechamber of the preparation chamber in a small amount of installation space if the prechamber of the preparation chamber has a conical configuration and widens towards the main chamber. In this case, the fact that the quantity of gas increases by the addition of the volumetric flows from the main nozzle and the preparation nozzle is also taken into account.

An advantageous further embodiment correspondingly provides for the prechamber to widen towards the main chamber, not just in this connection. Mixing of the mixtures added by the main nozzle and by the preparation nozzle can be improved further by means of such widening.

Furthermore, it is advantageous if the jet direction of the preparation nozzle and the jet direction of the main nozzle intersect in the prechamber. Particularly good and thorough mixing of the mixtures which are added by the main nozzle on one hand and the preparation nozzle on the other hand can be achieved thereby.

A preferred embodiment provides for a quantity of air which corresponds to a quantity of fuel which is introduced through the main nozzle into the main combustion chamber to be introduced into the main combustion chamber downstream of a preparation chamber. In this manner it is ensured that a preparation process of the fuel can be carried out reliably in the preparation chamber without combustion of the air which is added through the main nozzle of the main combustion chamber taking place.

It is particularly advantageous in this connection if the axial piston engine has a separate air supply to the combustion chamber. The separate air supply can be provided in a particularly simple manner in structural terms if a nozzle, preferably a preparation nozzle, has a perforated rim for an air supply. The air supply can however also be realised by separate channels which open into corresponding openings or separate nozzles in a combustion chamber.

It should be emphasised here that the terms "upstream" and "downstream" in each case refer to the main combustion direction or to the volumetric flow direction through the nozzles or chambers. It should likewise be emphasised that in the present connection the issue is in each case combustion air or air which is intended to bring about the combustion of the fuel. On the other hand, it is self-evident that the present invention can be implemented in a correspondingly advantageous manner for all fuels which react exothermally in a redox reaction with a second component.

A further solution of the present object proposes an axial piston engine with a combustion chamber which is insulated by means of a ceramic assembly, with the ceramic assembly being air-cooled. If the ceramic assembly is air-cooled, the thermal conditions of the combustion chamber of the axial piston engine can be controlled much better. In this respect the service life of the axial piston engine can also be improved thereby. The air which is heated in this manner can in particular be used for combustion, as a result of which the efficiency can be further increased in contrast to correspondingly water-cooled combustion chambers. Air cooling in the region of the combustion chamber, in particular of a ceramic combustion chamber can also be controlled more easily.

Specifically in this connection, the object of the invention is furthermore achieved by an axial piston engine with a combustion chamber which is insulated by means of a ceramic assembly, wherein the ceramic assembly has a tube-like configuration and is surrounded by a tube with profiling, preferably a thread. Such profiling can achieve an increase in the surface area, as a result of which cooling of the ceramic assembly can be much improved. The service life of the axial piston engine can also in particular be increased thereby, as the thermal conditions in the axial piston engine can be improved.

An embodiment which is improved in this respect provides for the profiled tube to be profiled on both sides, which for the sake of simplicity is provided on both sides with a thread. The profiled tube can thereby be in contact with the ceramic combustion chamber of the axial piston engine with a greater contact area and where necessary be screw-fastened. A thread furthermore has the advantage that it can ensure a uniform air flow in a structurally simple manner.

The object of the invention is also achieved irrespective of the other features of the present invention according to that given above by an axial piston engine in which compressed process air is used for cooling, in particular for cooling a combustion chamber. For example, this compressed process air can flow around the above-described profiled tube and additionally cool it in the process. Process air which is compressed in this manner can additionally already be present in the axial piston engine in a sufficient quantity for it to be used advantageously for cooling the axial piston engine.

A cooling effect can be further improved if water is added to the process air. If suitable means are provided for adding water to process air of the axial piston engine, water can also be mixed with the process air in an easily dosable manner.

The process air can be used very well for cooling not just directly around the combustion chamber. The water can in particular be added in addition or alternatively to this before or during the compression of the process air or also of a fuel/air mixture. Enough time then remains to heat the process air which is enriched with water in order to maximise the efficiency of the axial piston, wherein in particular waste heat from the combustion process, for example from cooling processes can be used accordingly to do this. The residual heat of the exhaust gas can also be used correspondingly.

The water is advantageously sprayed into a compression cylinder, as a result of which a uniform distribution of the water can be ensured.

If the quantity of water is furthermore controlled proportionally to the quantity of fuel, the water can also be used in a correspondingly advantageous manner in the combustion process. In this respect, spraying an excessive amount of water can be prevented so that the risk of the axial piston engine being cooled too much at a relatively low output can be reduced. The water can in particular also be used as a reagent and/or catalyst in the combustion process, in order to ensure for example a chemical conversion of undesirable exhaust constituents. The quantity of water needed for this also corresponds advantageously to the quantity of fuel converted in each case.

Depending on the actual process, the water can also be already thermally broken down before it passes into the main combustion chamber. This can for example likewise take place in the preparation chamber. On the other hand, the breakdown can also take place chemically or catalytically and/or at another point, for example in feed channels or in the immediate vicinity of inflow openings into the combustion chamber.

The object of the invention is additionally achieved by an axial piston engine with continuous combustion, in which working medium flowing out of a combustion chamber is guided successively to at least two working cylinders via at least one firing channel, wherein one firing channel is provided per working cylinder, which channel can be closed and opened by means of a control piston. The firing channels can be closed particularly tightly on one hand and opened again very quickly on the other hand by means of the control piston, which is not possible for example with rotary slides or rotating firing channels which are already known from the prior art. In this respect, the efficiency of an axial piston engine can be improved by this alone. Such control pistons can additionally close and release a firing channel in a particularly simple and robust manner in structural terms, as a result of which the service life of the axial piston engine can be further increased.

For example, the control piston can execute an essentially radially oriented stroke movement in order to be able to release a firing channel. In an embodiment which is preferred in this respect, the control pistons execute an essentially radially oriented stroke movement so that installation space can be saved axially. If a control piston alternatively executes an essentially axially oriented stroke movement, that is an essentially axially oriented stroke movement, cooling of the control piston can be realised in a more simple manner. In this respect, a choice is to be made between these solutions depending on the actual implementation, wherein a choice can also be made between an axial and a radial stroke movement, that is, at an angle, which however generally leads to more complex and therefore more costly results in structural terms.

In this connection, a further preferred embodiment provides for the control piston to be water-cooled, as a result of which overheating can be prevented particularly effectively, as the control pistons are exposed to particularly high temperatures in the firing channel.

In a preferred embodiment, the control pistons can be actuated hydraulically or pneumatically so that very fast closure times or movement profiles of the pistons can be realised. Alternatively, the control pistons can be actuated desmodromically. With desmodromic actuation, the control piston can close a firing channel exceptionally tightly and always in an operationally reliable manner, even at high speeds.

If the control piston is actuated over a curved path, it can be accelerated and delayed particularly rapidly. In particular, desmodromic actuation can be implemented particularly well in practical terms in this case.

If a piston cover of the control piston has a greater diameter than the firing channel, the heat loading of the control piston can be reduced in a much more advantageous manner.

Particularly simple fastening and guidance of the control piston can be realised in particular by sliding blocks or sliding bearings, as a result of which the control piston can at the same time be secured against rotation in a preferred embodiment. Exceptionally good sealing with respect to the control piston can be achieved if the control piston bears a control piston ring. If the control piston ring has a slot, the sealing function of the control piston ring can be further improved, as the control piston ring can be better adapted to the structural conditions, in particular to a control piston cylinder, in particular when it is loaded with pressure.

Furthermore, it is advantageous if the control piston ring is also secured against rotation, as the sealing function on the control piston can be further improved.

Further advantages, objectives and properties of the present invention are described using the following description of the attached drawing, in which a first exemplary embodiment of an axial piston engine is shown by way of example.

Figure 2:
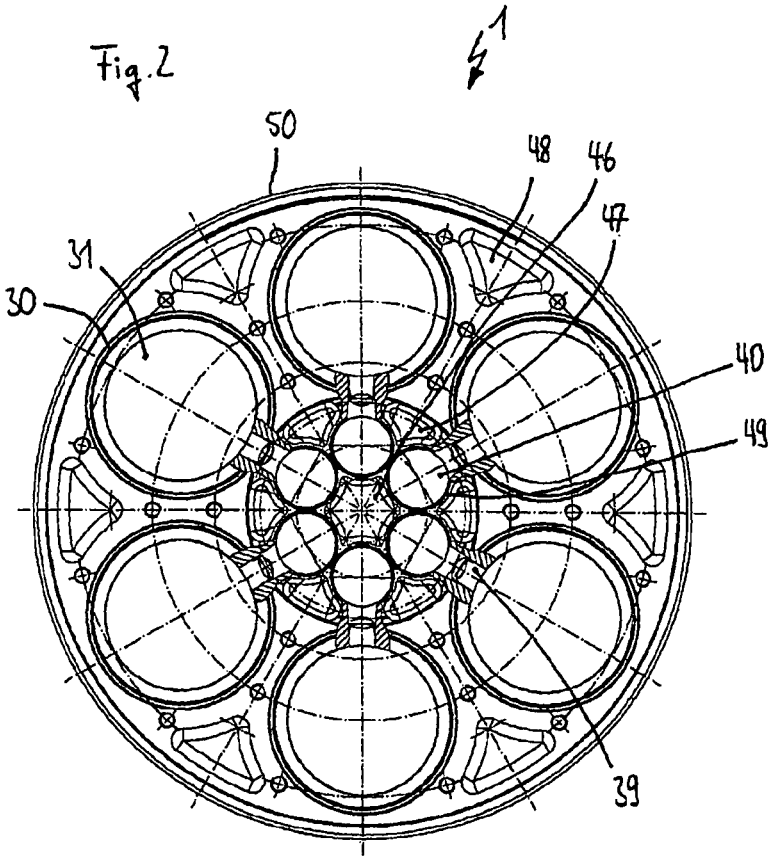

In the drawing,

FIG. 1 schematically shows an axial piston engine in longitudinal section;

FIG. 2 schematically shows the axial piston engine according to FIG. 1 in cross section along line H-H;

FIG. 3 schematically shows an enlarged illustration of the firing channel ring of FIG. 1;

FIG. 4 schematically shows a longitudinal section through a control piston as an alternative to the control piston according to FIGS. 1 and 2; and FIG. 5 schematically shows a cross section through the control piston according to FIG. 4 along the line V-V.

The axial piston engine 1 shown in FIG. 1 has a combustion chamber 2 in which a fuel/air mixture can be ignited and burned. The axial piston engine 1 advantageously operates with two-stage combustion. To this end, the combustion chamber 2 has a first region 3 and a second region 4 into which the fuel and/or air can be injected. In particular in the first region in 3, a portion of combustion air of the axial piston engine 1 can be introduced, wherein in this exemplary embodiment the portion of combustion air can be set to be less than 15% of the total combustion air.

The combustion chamber 2 of the axial piston engine 1 can be divided by the two regions 3 and 4 into a preparation chamber 5 and a main combustion chamber 6.

The preparation chamber 5 has a smaller diameter than the main combustion chamber 6, wherein the preparation chamber 5 is further divided into a prechamber 7 and a main chamber 8. The prechamber 7 has a conical configuration and widens towards the main chamber 8.

There is connected to the preparation chamber 5, in particular to the prechamber 7 of the preparation chamber 5, a main nozzle 9 on one side and a preparation nozzle 10 on the other side. A fuel can be introduced into the combustion chamber 2 by means of the main nozzle 9 and the preparation nozzle 10, wherein the fuel which is injected by means of the preparation nozzle 10 is already mixed with air.

The main nozzle 9 is aligned parallel to a main combustion direction 11 in the combustion chamber 2 of the axial piston engine 1. Furthermore, the main nozzle 9 is aligned coaxially to an axis of symmetry 12 of the combustion chamber 2 which lies parallel to the main combustion direction 11 in the combustion chamber 2.

The preparation nozzle 10 is aligned at an angle 13 to the main nozzle 9. In this respect, a jet direction 14 of the preparation nozzle 10 intersects a jet direction 15 of the main nozzle 9 at an intersection point 16.

The preparation chamber 5, into which both the main nozzle 9 and the preparation nozzle 10 are oriented, opens towards the main combustion chamber 6. Fuel is injected out of the main nozzle 9 into the preparation chamber 5 without additional supply of air. The fuel is already preheated, ideally thermally decomposed, in the preparation chamber 5.

To this end, the quantity of air which corresponds to the quantity of fuel which flows through the main nozzle 9 is introduced into the main combustion chamber 6 downstream of a preparation chamber 5, for which a separate air supply 17 is provided which opens essentially into the main combustion chamber 6. To this end, the separate air supply 17 is connected to a process air supply 18, wherein a further air supply 19 can be supplied with air, which supplies a perforated rim 20 with air. The perforated rim 20 is allocated to the preparation nozzle 10 so that the fuel which is injected with the preparation nozzle 10 can additionally be injected into the prechamber 7 of the preparation chamber 5 with process air.

The combustion chamber 2, in particular the main combustion chamber 6 of the combustion chamber 2, has a ceramic assembly 21 which is air-cooled. The ceramic assembly 21 in this case comprises a ceramic combustion chamber wall 22 which is surrounded by a profiled tube 23. A cooling air chamber 24 extends around this profiled tube 23, which cooling air chamber is operatively connected to the process air supply 18 by means of a cooling air chamber supply 25.

Furthermore, the axial piston engine 1 has working cylinders 30 which are known per se (see in particular FIG. 2), in which working pistons 31 can be moved forwards and backwards.

Compressor pistons 32 of the axial piston engine 1 are driven by means of the working pistons 31, which compressor pistons can be moved correspondingly in suitable compressor cylinders 33 of the axial piston engine 1. The working pistons 31 are connected to the compressor pistons 32 in each case by means of a connection rod 34, wherein a connection rod wheel 35 is arranged in each case between the working piston 31 and the connection rod 34 and between the compressor piston 32 and the connection rod 34. A drive curved path 36 is enclosed in each case between two connection rod wheels 35, which drive curved path is guided on a drive curved path support 37. Opposite the combustion chamber 2, the axial piston engine 1 has a drive shaft 38, by means of which the power generated by the axial piston engine 1 can be output. The process air is compressed in the compressor pistons 32 in a manner which is known per se, including where applicable the injected water, which may lead to additional cooling, as a result of which however the exhaust gases can if applicable be cooled much more in a heat exchanger if the process air is to be guided to the combustion chamber 2 preheated by means of such a heat exchanger, wherein the process air can be heated or preheated by contact with other assemblies of the axial piston engine 1 which must be cooled, as described above. The process air which has been compressed and heated in this manner is then added to the combustion chamber 2 in a manner which has already been explained.

Each of the working cylinders 30 is connected to the combustion chamber 2 of the axial piston engine 1 by means of a firing channel 39, so that the fuel/air mixture can pass out of the combustion chamber 2 via the firing channel 39 and into the working cylinder 30, and can drive the working piston 31 there.

In this respect the working medium flowing out of the combustion chamber 2 can be supplied successively to at least two working cylinders 30 via at least one firing channel 39, wherein one firing channel 39 is provided per working cylinder 30, which firing channel can be closed and opened by means of a control piston 40. The number of the control pistons 40 of the axial piston engine 1 is thus also predefined by the number of the working cylinders 30.

The firing channel 39 in this case is closed essentially by means of the control piston 40 with its piston cover 41. The control piston 40 is driven by means of a control piston curved path 42, wherein a spacer 43 for the control piston curved path 42 to the drive shaft 38 is provided, which is also used in particular for thermal decoupling. In the present exemplary embodiment, the control piston 40 can execute an essentially axially oriented stroke movement 44. To this end, each control piston 40 is guided by means of sliding blocks (not numbered) which are mounted in the control piston curved path 42, wherein the sliding blocks in each case have a securing cam which runs back and forth in a guide groove (not numbered) and prevents the control piston 40 from rotating.

As the control piston 40 comes into contact with the hot working medium from the combustion chamber 2 in the region of the firing channel 39, it is advantageous if the control piston 40 is water-cooled. To this end, the axial piston engine 1 has a water-cooling system 45, in particular in the region of the control piston 40, wherein the water-cooling system 45 comprises inner cooling channels 46, intermediate cooling channels 47 and outer cooling channels 48. Well-cooled in this manner, the control piston 40 can be moved in an operationally reliable manner in a corresponding control piston cylinder 49.

The firing channels 39 and the control pistons 40 can be provided in the axial piston engine 1 in a particularly simple manner in design terms if the axial piston engine 1 has a firing channel ring 50 as is illustrated in particular in FIG. 3.

The firing channel ring 50 has a centre axis 51, around which in particular the parts of the working cylinders 30 and the control piston cylinders 49 of the axial piston engine 1 are concentrically arranged. A firing channel 39 is provided between each working cylinder 30 and control piston cylinder 49, wherein each firing channel 39 is connected spatially with a recess 52 (see FIG. 3) of a combustion chamber bottom 53 (see FIG. 1) of the combustion chamber 2 of the axial piston engine 1. The working medium can thus pass from the combustion chamber 2 via the firing channels 39 and into the working cylinders 30, and carry out work there, by means of which the compressor cylinders 33 of the axial piston engine 1 can also be moved. It is self-evident that, depending on the actual configuration, coating and inserts can also be provided in order to protect the firing channel ring 50 or its material from direct contact with corrosive combustion products or excessive temperatures.

The alternative control piston 60 which is shown by way of example in FIGS. 4 and 5 has a wheel 61 for the control piston curved path 37 of the axial piston engine 1. The wheel 61 is provided on an end 64 of the control piston 60 which faces away from the piston cover 41 in the same manner as a rotation securing means 63 which is configured as a ball 62. The ball 62 can advantageously also be used as a longitudinal guide of the control piston 60 in the present case. Furthermore, the control piston 60 comprises a piston ring 65, which is situated directly below the piston cover 41. The piston ring 65 is secured on the control piston 60 by means of a piston ring securing means 66. A pressure compensation means 67 for the control piston 60 is also provided between the piston ring 65 and the ball 62.

LIST OF REFERENCE SYMBOLS

1 Axial piston engine
2 Combustion chamber
3 First region
4 Second region
5 Preparation chamber
6 Main combustion chamber
7 Prechamber
8 Main chamber
9 Main nozzle
10 Preparation nozzle
11 Main combustion direction
12 Axis of symmetry
13 Angle
14 Jet direction of preparation nozzle
15 Jet direction of main nozzle
16 Intersection point
17 Separate air supply
18 Process air supply
19 Further air supply
20 Perforated rim
21 Ceramic assembly
22 Ceramic combustion chamber wall
23 Profiled tube
24 Cooling air chamber
25 Cooling air chamber supply
30 Working cylinder
31 Working piston
32 Compressor piston
33 Compressor cylinder
34 Connection rod
35 Connection rod wheel
36 Drive curved path
37 Drive curved path support

38 Drive shaft
39 Firing channel
40 Control piston
41 Piston cover of control piston
42 Control piston curved path
43 Spacer for control piston curved path
44 Axially oriented stroke movement
45 Water-cooling system
46 Inner cooling channels
47 Intermediate cooling channels
48 Outer cooling channels
49 Control piston cylinder
50 Firing channel ring
51 Centre axis
52 Recess
53 Combustion chamber bottom
60 Alternative control piston
61 Wheel
62 Ball
63 Rotation securing means
64 End facing away
65 Piston ring
66 Piston ring securing means
67 Pressure-compensating means

The invention claimed is:

1. An axial piston engine with continuous combustion which operates with two-stage combustion comprises:

a combustion chamber;

a main fuel nozzle;

a preparation fuel nozzle;

wherein the combustion chamber comprises a main combustion chamber and a preparation chamber, wherein a portion of combustion air is introduced into the preparation chamber and the preparation fuel nozzle injects a corresponding quantity of preparation fuel into the preparation chamber, wherein the preparation chamber is arranged upstream of the main combustion chamber, wherein main fuel is added into the preparation chamber by the main fuel nozzle, which main fuel is heated in the preparation chamber, wherein exhaust gas or a preparation fuel/air mixture is introduced into the preparation chamber from the preparation fuel nozzle, wherein the main fuel injected into the preparation chamber from the main fuel nozzle is injected without an air supply ensuring that a preparation process of the main fuel is carried out in said preparation chamber without combustion, and wherein a quantity of air which corresponds to a quantity of main fuel introduced into the main combustion chamber through the main fuel nozzle is introduced into the main combustion chamber downstream of the preparation chamber;

at least two working cylinders;

at least one firing channel provided per each working cylinder; and a control piston for closing and opening the at least one firing channel to control combustion products flowing out of the main combustion chamber to the at least two working cylinders.

2. Axial piston engine according to claim 1, wherein the portion of combustion air is less than 50% of the total combustion air.

3. Axial piston engine according to claim 1, wherein the main fuel nozzle is aligned parallel to a main combustion direction in the combustion chamber.

4. Axial piston engine according to claim 3, wherein the main fuel nozzle is aligned coaxially to an axis of symmetry of the combustion chamber which lies parallel to the main combustion direction in the combustion chamber.

5. Axial piston engine according to claim 1, wherein the preparation fuel nozzle is aligned at an angle to the main fuel nozzle.

6. Axial piston engine according to claim 5, wherein a jet direction of the preparation fuel nozzle intersects a jet direction of the main fuel nozzle.

7. Axial piston engine according to claim 1, wherein both the main fuel nozzle and the preparation fuel nozzle are oriented into the preparation chamber and wherein the preparation chamber opens towards the main combustion chamber.

8. Axial piston engine according to claim 1, wherein the preparation fuel nozzle opens into the preparation chamber, via which the main fuel is heated in the preparation chamber.

9. Axial piston engine according to claim 7, wherein the preparation chamber is aligned parallel to a main combustion direction in the combustion chamber.

10. Axial piston engine according to claim 9, wherein the preparation chamber is aligned coaxially to an axis of symmetry of the combustion chamber which lies parallel to the main combustion direction in the combustion chamber.

11. Axial piston engine according to claim 7, wherein the preparation chamber has a smaller diameter than the main combustion chamber.

12. Axial piston engine according to claim 7, wherein the preparation chamber comprises a prechamber and a main chamber.

13. Axial piston engine according to claim 12, wherein a jet direction of the preparation fuel nozzle and a jet direction of the main fuel nozzle intersect in the prechamber.

14. Axial piston engine according to claim 12, wherein the prechamber widens towards the main chamber.

15. Axial piston engine according to claim 1, further comprising a separate air supply to the combustion chamber.

16. Axial piston engine according to claim 1, wherein one of the main fuel nozzle and the preparation fuel nozzle has a perforated rim for an air supply.

17. Axial piston engine with continuous combustion according to claim 1, wherein a piston cover of the control piston has a greater diameter than the firing channel.

18. Axial piston engine according to claim 1, wherein the control piston executes an essentially radially oriented stroke movement.

19. Axial piston engine according to claim 1, wherein the control piston executes an essentially axially oriented stroke movement.

20. Axial piston engine according to claim 1, wherein the control piston is water-cooled.

21. Axial piston engine according to claim 1, wherein the control piston is actuated desmodromically.

22. Axial piston engine according to claim 1, wherein the control piston is actuated over a curved path.

23. Axial piston engine according to claim 1, wherein the control piston is secured against rotation.

24. Axial piston engine according to claim 1, wherein the control piston bears a control piston ring.

25. Axial piston engine according to claim 24, wherein the control piston ring has a slot.

26. Axial piston engine according to claim 24, wherein the control piston ring is secured against rotation.

* * * * *